US006910340B2

(12) United States Patent
Nowak et al.

(10) Patent No.: US 6,910,340 B2
(45) Date of Patent: Jun. 28, 2005

(54) AIRFLOW CONTROL DEVICE

(75) Inventors: David R. Nowak, Chicago, IL (US); Robert Dam, Aurora, IL (US); Anthony Caringella, Norridge, IL (US)

(73) Assignee: Illinois Tool Works Inc., Glenview, IL (US)

( * ) Notice: Subject to any disclaimer, the term of this patent is extended or adjusted under 35 U.S.C. 154(b) by 86 days.

(21) Appl. No.: 10/401,395

(22) Filed: Mar. 6, 2003

(65) Prior Publication Data

US 2004/0123610 A1 Jul. 1, 2004

Related U.S. Application Data

(60) Provisional application No. 60/373,040, filed on Apr. 16, 2002.

(51) Int. Cl.[7] ..... F25B 1/00

(52) U.S. Cl. ..... 62/115; 62/187; 236/49.5; 454/334

(58) Field of Search ..... 62/187, 186, 406, 62/408; 236/49.5, 68 R; 454/256, 258, 324, 334

(56) References Cited

U.S. PATENT DOCUMENTS

| | | | | |
|---|---|---|---|---|
| 3,288,370 A | | 11/1966 | Mingrone et al. | |
| 3,645,108 A | | 2/1972 | Houk | 62/187 |
| 4,276,754 A | | 7/1981 | Ty | 62/187 |
| 4,569,206 A | * | 2/1986 | Mitani et al. | 62/156 |
| 4,608,474 A | * | 8/1986 | Kohka | 219/681 |
| 4,635,610 A | * | 1/1987 | Nakanishi | 126/21 A |
| 4,646,531 A | | 3/1987 | Song | 62/187 |
| 4,653,283 A | | 3/1987 | Sepso | 62/89 |
| 4,688,393 A | | 8/1987 | Linstromberg et al. | 62/187 |
| 4,735,057 A | | 4/1988 | Janke | 62/187 |
| 4,815,302 A | | 3/1989 | Aoki et al. | 62/378 |
| 4,819,442 A | | 4/1989 | Sepso et al. | 62/187 |
| 4,843,833 A | | 7/1989 | Polkinghorne | 62/180 |
| 4,903,501 A | | 2/1990 | Harl | 62/187 |
| 4,945,732 A | * | 8/1990 | Haruyama et al. | 62/256 |
| 5,144,813 A | | 9/1992 | Orner et al. | 62/187 |
| 5,176,544 A | * | 1/1993 | AbuJudom, II et al. | 439/878 |
| 5,375,413 A | | 12/1994 | Fredell et al. | 62/187 |
| 5,585,024 A | * | 12/1996 | Kosugi | 219/494 |
| 5,758,512 A | * | 6/1998 | Peterson et al. | 62/407 |
| 5,842,312 A | * | 12/1998 | Krumme et al. | 52/167.1 |
| 5,870,900 A | | 2/1999 | Mohebbi et al. | 62/187 |
| 5,876,014 A | | 3/1999 | Noritake et al. | 251/129.12 |
| 6,062,315 A | * | 5/2000 | Reinhardt | 166/381 |
| 6,216,779 B1 | * | 4/2001 | Reinhardt | 166/57 |
| 6,301,910 B1 | | 10/2001 | Noritake et al. | 62/187 |
| 6,336,339 B1 | | 1/2002 | Joung et al. | 62/285 |
| 6,436,223 B1 | * | 8/2002 | Edwards et al. | 156/288 |
| 6,467,392 B1 | * | 10/2002 | Breuning et al. | 91/447 |
| 2001/0011462 A1 | | 8/2001 | Cho et al. | 62/187 |

FOREIGN PATENT DOCUMENTS

| | | | |
|---|---|---|---|
| JP | 363279051 A | * | 11/1988 |
| JP | 02008572 | | 12/1990 |
| JP | 02001020408 A | * | 1/2001 |

* cited by examiner

*Primary Examiner*—William Doerrler
*Assistant Examiner*—Mohammad M. Ali
(74) *Attorney, Agent, or Firm*—Mark W. Croll; Paul F. Donovan

(57) ABSTRACT

An airflow control device has a fixed damper element and a movable damper element. Shape memory wires are connected to the fixed damper element and the movable damper element. The shape memory wires are alternately electrified to cause the contraction thereof to move the movable damper element in opposite directions. A heater can be provided along with the damper elements to overcome frost buildup in cold environments, such as refrigeration systems.

20 Claims, 3 Drawing Sheets

AIRFLOW CONTROL DEVICE

CROSS-REFERENCE TO RELATED APPLICATIONS

This application claims benefit to U.S. Provisional Patent Application Ser. No. 60/373,040, filed on Apr. 16, 2002.

FIELD OF THE INVENTION

The present invention relates generally to airflow control devices, and, more particularly to dampers for regulating the flow of air between one compartment and another compartment, such as for example, between a freezer section and a refrigerated section of a refrigerator.

BACKGROUND OF THE INVENTION

There are many known airflow control devices for regulating the flow of air from one area to another area. In regards to refrigerators in particular, known refrigerator arrangements utilize a compressor refrigeration system for chilling the environment within the freezer compartment of the refrigerator. The refrigerated food compartment of the refrigerator is cooled by moving cold air from the freezer compartment into the refrigerated compartment. An airflow damper is provided between the refrigerated compartment and the freezer compartment to regulate the amount of cold air that is allowed to pass from the freezer compartment to the refrigerated compartment.

It is known to provide some type of user input for regulating and controlling the operation of the airflow damper. In lower end refrigerators, the damper mechanism commonly is a simple slider type damper having a fixed opening and a slide thereover. The slide portion is connected to a knob via a rod or other link mechanism. Adjustment of the knob position moves the slider mechanism to adjust the effective size of the opening through the damper, to regulate, at least to some limited extent, the amount of cold air allowed to enter the refrigerated compartment from the freezer compartment. The slider remains in the selected position until moved again by readjustment of the knob position. While some minimal control results, the refrigerated compartment is not truly temperature controlled, and will become colder or warmer under various operating and use conditions of the refrigerator. For example, if the refrigerated compartment is opened frequently and the damper is positioned for substantially restricted flow, insufficient airflow from the freezer compartment will result in the refrigerated compartment becoming warm. Conversely, if the refrigerated compartment is opened only infrequently, the temperature therein may approach the temperature of the freezer compartment with a fixed opening damper as described. Advantages of this type of damper include simplicity and inexpensive cost. A disadvantage is the relative inaccuracy of the temperature control provided thereby.

In a somewhat more functional design, the damper is a mechanically operated device connected to a thermostat. Refrigerant in the damper mechanism provides operational control. As the temperature in the refrigerated compartment changes, the refrigerant will expand or contract. Thus, if the refrigerated compartment door is opened frequently, or left open for long periods of time such that the compartment warms, the refrigerant will expand, causing the damper to open. As the refrigerated compartment cools, the refrigerant contracts, in turn causing the damper to close. Thus, damper opening and closing is controlled in relation to the actual temperature in the refrigerated compartment. Disadvantages of systems of this type include the cost and complexity of the system, wider than desirable temperature swings in the refrigerated compartment, and the disadvantage of using a toxic fluid in the control system.

In general, more energy efficient refrigerators have electronically controlled refrigerated and freezer compartments. A micro-controller monitors the refrigerator use and compartment temperatures, and controls airflow between the compartments for precisely regulated temperature in the refrigerated compartment. An electrically actuated damper receives a signal from the micro-controller, determining when to open and close the damper. User input adjusts the relative temperature level to which the refrigerated compartment is controlled. Drawbacks to known systems of this type include the relative complexity of the system and the cost associated with it. The electrically actuated damper is typically a motor driven device consisting of a gearbox and capacitors. The motor and gearbox are relatively robust to withstand potential frost or freezing conditions in the damper unit. The motor has sufficient power along with the gearbox to break loose the moveable components, if frosting or freezing occurs. Nevertheless, severe frost over can cause the damper to malfunction and can result in damage. Systems of this type are undesirably large, reducing the space available for storing food.

What is needed in the art is a refrigerator damper capable of accurately regulating the refrigerated compartment temperature, yet which is simple, compact and inexpensive to manufacture. Additionally, new, inexpensive and reliable methods to control frost over of the damper are needed.

SUMMARY OF THE INVENTION

The present invention meets the aforementioned needs and other needs by providing according to one aspect thereof an airflow control device using shape memory wire to open and close a damper. For particularly cold applications, such as in a refrigerator, according to another aspect of the present invention there is provided in association with the airflow control device a heater to control frost over or freeze up.

In one form thereof, the present invention provides a damper with a first damper element and a second damper element, each having an opening therethrough. One of the damper elements overlies the other of the damper elements. At least one of the damper elements is movable relative to the other. A shape memory member adapted to contract in length upon application of an electric current thereto, and to elongate upon interruption of the current thereto, is attached to the at least one of the elements for causing movement of the at least one element by contraction of the member. An electric current source is electrically connected to the member for selectively applying electrical current to the member. When the electrical current is cut-off, the shape memory member effectively cools, thereby allowing the member the ability to return to its original shape.

In another form thereof, the present invention provides a refrigerator damper with a fixed damper element having a first plurality of openings therethrough, and a movable damper element juxtaposed over the fixed element and having a second plurality of openings therethrough. The movable damper element is movable between a first position in which the second plurality is not aligned with the first plurality and a second position in which the second plurality of openings is in substantial alignment with the first plurality of openings. A shape memory wire has one end attached to the movable damper and a second end attached to the fixed damper element to cause movement of the movable damper upon heating of the wire.

In yet another form thereof, the present invention provides a method for controlling airflow between two compartments, such as, for example, of a refrigerator. The method has steps of providing a movable damper element having at least one opening therethrough, the damper element being movable between first and second positions providing different airflow through the element; providing a shape memory member attached to the damper element, the member being responsive to a temperature thereof to change a physical dimension thereof; providing an electric circuit electrically connected to the member; and moving the movable damper element by selectively directing an electric current to the shape memory member or interrupting an electric current directed to the shape memory member in response to a need to adjust the position of the movable damper element.

An advantage of the present invention is providing a simple yet reliable damper that is easy to install and reliable in operation for an extended useful lifetime.

Another advantage of the present invention is providing a damper that is compact and relatively inexpensive to install and operate.

Yet another advantage of the present invention is providing a damper having simple yet reliable heater means for eliminating frost over and insuring reliable damper operation in cold environments, such as found in a refrigerator.

Still another advantage of the present invention is providing a strong, compact activation mechanism that is easy to control and operate.

Other features and advantages of the invention will become apparent to those skilled in the art upon review of the following detailed description, claims and drawings in which like numerals are used to designate like features.

BRIEF DESCRIPTION OF THE DRAWINGS

FIG. 2 is a plan view of the damper shown in FIG. 1, but illustrating the damper in an open position allowing airflow there through;

Figure 1:
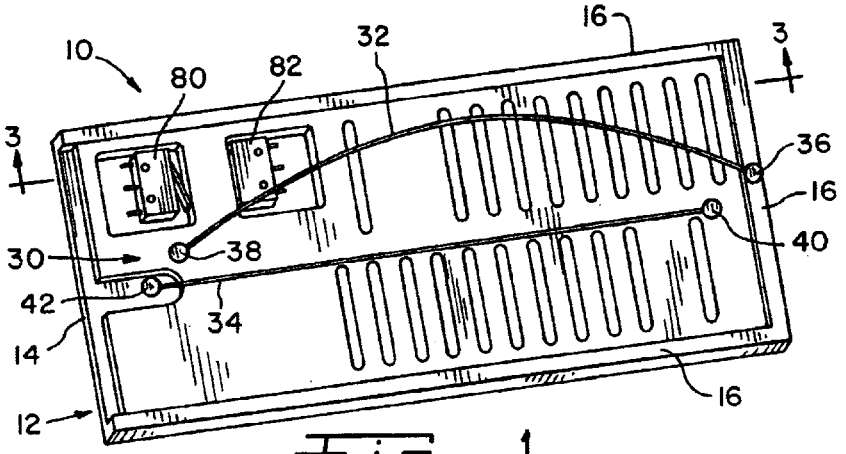
FIG. 1 is a perspective view of a damper or airflow control device according to the present invention, illustrating the damper in a closed position.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including" and "comprising", and variations thereof, is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, numeral 10 designates a damper in accordance with the present invention. Damper 10, as shown and described below, is provided in an airflow duct between a refrigerated compartment and a freezer compartment of a refrigerator. Those skilled in the art will understand that damper 10 may operate directly in an opening provided in a wall between the refrigerator and freezer compartments, or damper 10 may operate in a duct directing airflow from the freezer compartment to the refrigerated compartment. Flow through damper 10 may be natural airflow, or flow therethrough may be induced by a fan or other air moving device. It should be noted that although the invention is described in connection with a refrigerator, the invention is capable of use in other airflow control applications, and a refrigerator is merely shown and described as an example of one such application.

Damper 10 includes a first damper element in the nature of a fixed frame 12 having a base 14 and peripheral guides 16 disposed about base 14. In the exemplary embodiment illustrated, base 14 is provided with guides 16 along elongated sides and one end thereof. Base 14 is provided with a plurality of airflow openings 18 (FIG. 3) which allow air to pass from one side of base 14 to the opposite side of base 14. Openings 18, only some of which are identified with the reference number 18 in the drawings, are shown as relatively narrow, elongated openings, but other configurations can also be used.

Figure 2:
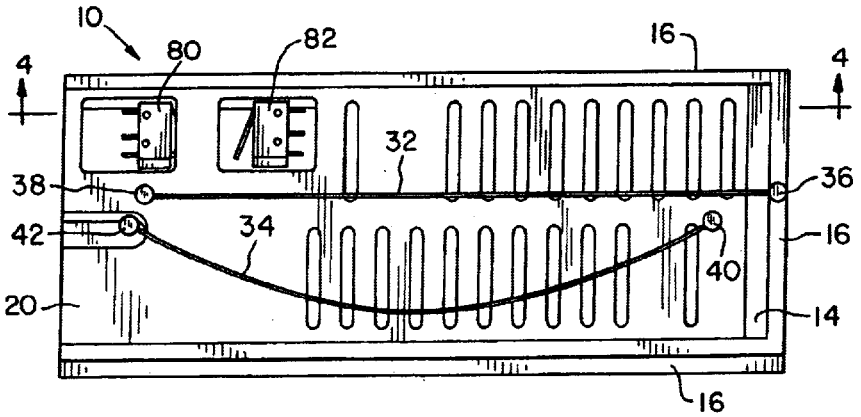

Damper 10 is further provided with a second damper element in the nature of a slider 20 (FIG. 2) overlying base 14, and moveable relative to base 14 within the confines of guides 16. Slider 20 fits relatively close between guides 16 for controlling the relative movement of slider 20 with respect to base 14. Other types of guide mechanisms including tracks and the like can be used.

Figure 3:
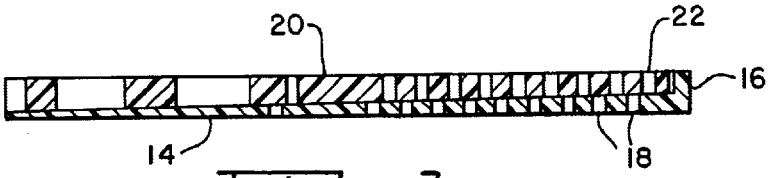
FIG. 3 is a cross sectional view of the damper shown in FIG. 1, taken along line 3—3 of FIG. 1.
Figure 4:
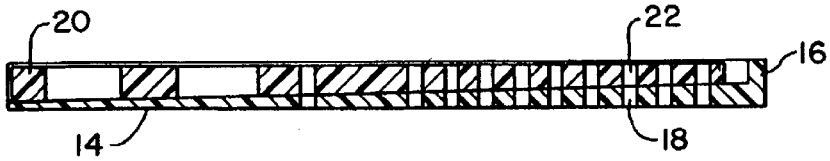
FIG. 4 is a cross sectional view of the damper shown in FIG. 2, taken along line 4—4 of FIG. 2.

Slider 20 is provided with a plurality of airflow openings 22 (FIG. 3) therethrough. Airflow openings 22, only some of which are identified with the reference number 22 in the drawings, are similar in size, shape and relative positioning to airflow openings 18. Slider 20 is movable relative to base 14 such that airflow openings 22 therein can be positioned in substantial alignment with airflow openings 18 in base 14, or can be positioned in misalignment with airflow openings 18. Thus, as illustrated in FIG. 3, when misaligned, airflow through damper 10 is inhibited. As illustrated in FIG. 4, when airflow openings 22 are aligned with airflow openings 18, air can flow through damper 10 so that chilled air from a freezer compartment of a refrigerator can flow through damper 10 to the refrigerated compartment of the refrigerator, thereby cooling the refrigerated compartment.

Movement of slider 20 relative to base 14 occurs through operation of an actuator mechanism 30. Actuator mechanism 30 includes first and second shape memory members 32 and 34 in the nature of wires anchored between frame 12 and slider 20. Thus, shape memory wire 32 includes a first end connected to a first anchor 36 on frame 12 and a second end connected to a first second anchor 38 on slider 20. Similarly, shape memory wire 34 includes a first end connected to a second anchor 42 on frame 12 and a second end connected to second anchor 40 on slider 20.

Shape memory wire is a known material, referred to as shape memory alloys, such as nickel titanium alloy which, when heated contracts in length. Transition is rapid at the transition temperature, which is determined by the ratio of nickel to titanium in the alloy. Wires of shape memory alloy can be made to contract an amount based on a percentage of the relaxed wire length, such as, for example, 6–10%. Shape memory alloys commonly have a high electrical resistance, and can be heated to the transition temperature by passing an electric current therethrough. By controlling a flow of electricity through shape memory wires 32 and 34, accurate operation thereof is made to cause the wires to selectively contract, thereby moving slider 20 in one direction or another. Upon interruption of the flow of electric current through shape memory wires 32 or 34, rapid cooling occurs and elongation results, thereby allowing slider 20 to be pulled by the other shape memory wire 32 or 34 in the opposite direction.

Under proper operating conditions, the shrinkage factor of shape memory wire is accurate and repeatable at the transition temperature over a prolonged life (more than one million cycles). A bias force is provided to the wire in the direction of elongation, to assist in returning the wire to the relaxed state and dimensions thereof. While springs can be used, with wires 32 and 34 contracting in opposite directions, a bias force that is passive in the contracted direction after completion of movement is desirable.

Figure 5:
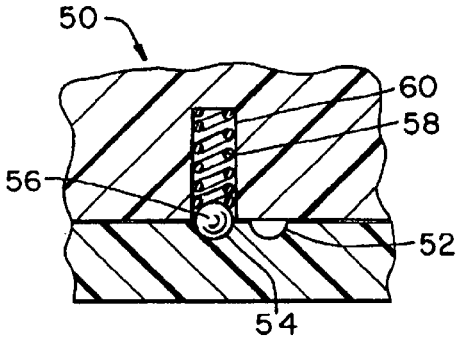
FIG. 5 is an enlarged cross sectional view of a detent mechanism in the damper of the present invention.
Figure 6:
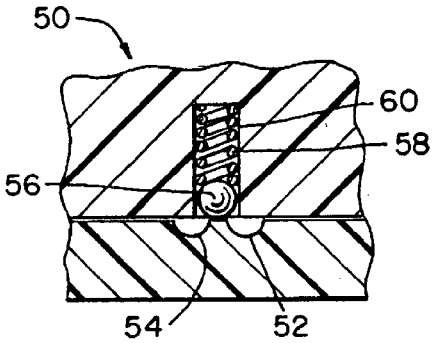
FIG. 6 is a cross sectional view similar to that of FIG. 5, but illustrating the detent mechanism in a different stage of operation from that shown in FIG. 5.
Figure 7:
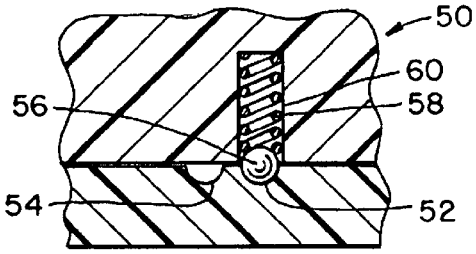
FIG. 7 is an enlarged cross sectional view similar to that of FIGS. 5 and 6, but illustrating the detent mechanism in yet another stage of operation.

According to one embodiment of the present invention, a mechanical assist in the way of detent mechanism 50 (FIGS. 5, 6 and 7) is provided for supplying mechanical assist or biasing force to the final movement of each wire 32 and 34 in its direction of elongation. Detent mechanism 50 includes first and second cavities 52 and 54 provided in frame 12, such as in one of the elongated side guides 16 along which slider 20 is moved. A ball 56 urged by a spring 58 from a slot 60 in slider 20 is provided to operate between first and second cavities 52 and 54. Thus, as slider 20 moves between the fully opened and fully closed positions of damper 10, ball 56 rolls between first cavity 52 and second cavity 54. As ball 56 rolls into either first cavity 52 or second cavity 54, the slopped side walls of the cavity function together with the outwardly urged ball 56 to provide a biasing force or mechanical assist for final movement of slider 20 in one or the other direction. First and second cavities 52 and 54 can be shaped as needed for providing the degree and type of mechanical assist desired. Thus, cavities 52 and 54 can be provided of the substantially spherical shapes shown for receiving ball 56 therein, or more gently sloping entrance and exit surfaces can be provided for each cavity 52 or 54. When ball 56 is seated within cavity 54 or cavity 56, damper 10 is latched in either its closed or opened position. Other assist mechanisms may be used in accordance with the principles of the present invention.

Although the shape memory members 32 and 34 can be designed and configured to accommodate frost build up, according to one aspect of the present invention, to minimize frost that could result in freeze-up of damper 10, a heater 62 (FIG. 9) is provided. In one advantageous configuration for heater 62, a positive temperature co-efficient (PTC) layer 64 (FIG. 8) is provided between base 14 and slider 20. PTC layer 64, as known to those skilled in the art, is caused to heat upon receipt of an electric current. By providing a heater layer 64 between base 14 and slider 20, any frost build-up or freezing is heated, thereby loosening slider 20 relative to base 14, and enabling sliding movement of slider 20 over base 14. Alternatively, blanket style heaters or heating rods can be used in accordance with the principles of the present invention.

In yet another advantageous embodiment for heater 62, one or the other of base 14 or slider 20, or a part thereof, can be made of PTC material.

Figure 8:
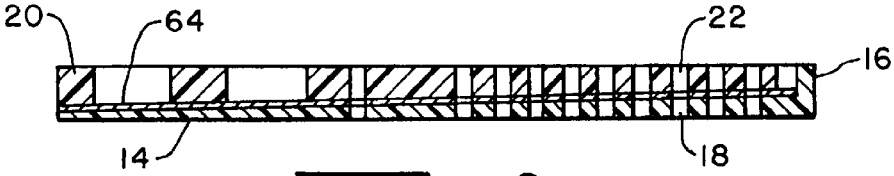
FIG. 8 is a cross sectional view of a modified form of the damper of the present invention, the view being similar to that shown for the first embodiment in FIG. 4.

Also as illustrated in FIG. 8 (as well as FIG. 4), base 14 and slider 20 are provided with oppositely angled mating surfaces, or draft, so that the surfaces are in contact with each other only in an extreme position of slider 20. Through out movement of slider 20, in either direction, the surfaces are spaced from each other, and sliding resistance of the surfaces against each other is reduced. Accordingly, although not clearly shown, it should be understood that when in the open position, base 14 and slider 20 are preferably slightly spaced apart over a portion of their opposing surfaces.

Figure 9:
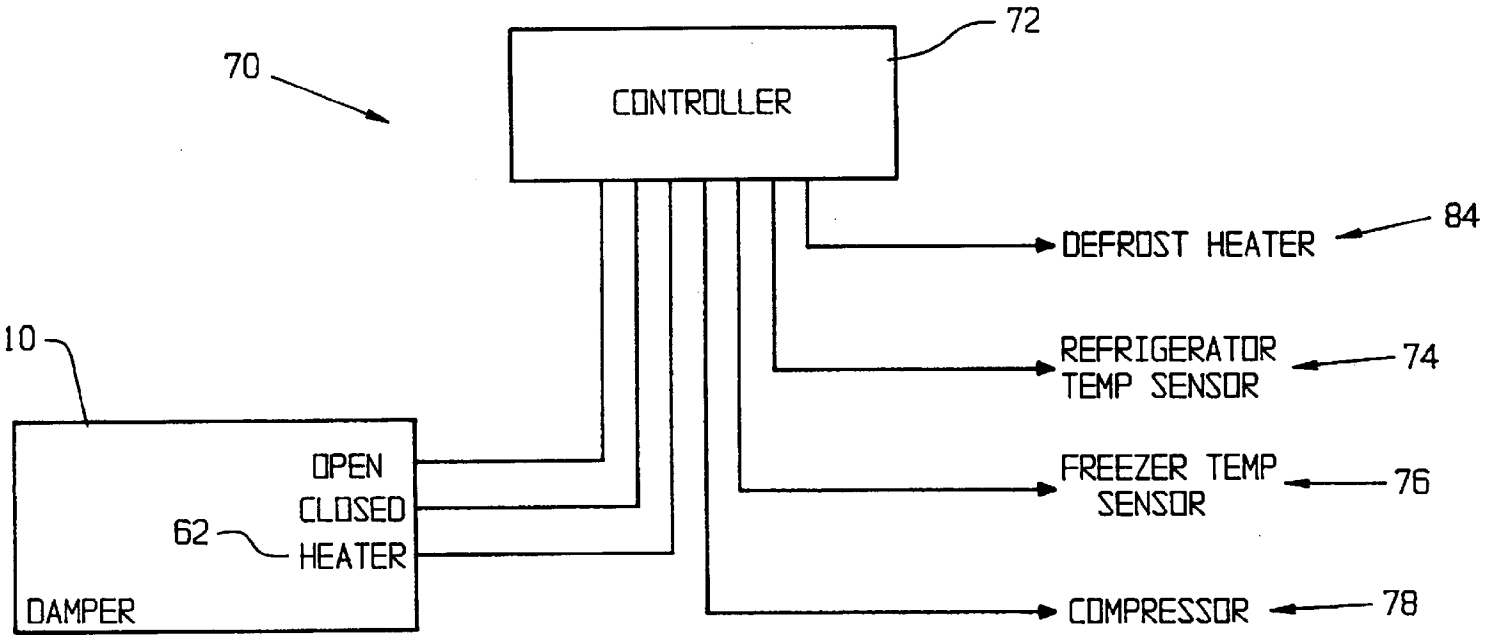
FIG. 9 is schematic view of a control system for the damper of the present invention.

FIG. 9 illustrates a general schematic of an electric circuit 70 by which damper 10 can be operated. A controller 72 is provided as a main controller for operation of the refrigerator. Controller 72 controls starting and stopping of numerous refrigerator functions. In that regard, controller 72 communicates with a refrigerated compartment temperature sensor 74 and a freezer compartment temperature sensor 76 to ascertain the temperature existing in each compartment. User input information is provided to controller 72 relative to the desired freezer compartment and refrigerated compartment temperature levels and, based on existing conditions and use, controller 72 can actuate a compressor 78 or other components of a refrigeration system to cause cooling in the freezer compartment. As necessary, controller 72 also actuates damper 10 to enable or disable cold airflow from the freezer compartment to the refrigerated compartment.

For actuating and de-actuating shaped memory members 32 and 34, limit switches 80 and 82 (FIG. 1) are provided in a circuit between controller 72 and shape memory members 32 and 34. Controller 72 is further operated to actuate defrost heater 62 of damper 10, or a main defrost unit 84 for the main refrigerator compartments. The function of heater 62 can be on a periodic schedule in conjunction with or separately from main defrost unit 84 or, more advantageously heater 62 can be actuated to briefly heat damper 10 before actuation of either shape memory member 32 or 34. Another function of the limit switches 80 and 82 is that they can indicate the state of the damper 10 (i.e., open or closed) when the system is faced with a power failure. In this way, the system or controller 72 knows the actual state of the damper 10 and cannot incorrectly determine that the damper 10 is opened when it is actually closed, or closed when it is actually opened.

While damper 10 has been shown and described herein as generally rectangular in shape, it should be understood that damper 10 can be of other shapes as well. For example, damper 10 can be generally round, with a movable damper element rotatable about an axis relative to a fixed damper element. Further, while described herein as operable between freezer and refrigerated compartments of a refrigerator, a damper including the principles of operation of the present invention can be used for controlling flow therethrough between other compartments or drawers within a refrigerator, and in devices other than a refrigerator, such as, for example, other appliances, automobile air heating and/or cooling systems, and other airflow control devices.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An airflow control device, comprising:

a first damper element and a second damper element, each having an opening therethrough, one of said damper elements overlying the other of said damper elements, at least one of said damper elements being movable relative to the other;

a shape memory member adapted to contract in length upon application of an electric current thereto and to elongate upon interruption of the current thereto, said member attached to said at least one of said elements for causing movement of said at least one element by contraction of said member;

an electric current source electrically connected to said member for selectively applying electrical current to said member; and a mechanical assist mechanism operable to complete movement of said at least one of said elements in at least one direction.

2. The device of claim 1, one of said damper elements being fixed in position and the other of said damper elements being movable relative thereto.

3. The device of claim 2, each said damper element having at least one opening therethrough.

4. The device of claim 1, said shape memory member being a wire, with one end of said wire anchored to said at least one of said elements, and another end of said wire anchored to the other of said elements.

5. The device of claim 1, including two shape memory members each attached to said at least one of said elements for moving said at least one of said elements in opposite directions.

6. The device of claim 5, each said shape memory member being a wire and each of said wires having a first end connected to a first anchor on said at least one of said elements and a second end connected to a second anchor on the other of said elements.

7. The device of claim 1, said mechanical assist mechanism operable to complete movement of said at least one of said elements in each direction.

8. The device of claim 7, said mechanical assist mechanism including adjacent cavities and a spring biased member movable into said cavities.

9. The device of claim 1, including an electronic controller adapted to send the electronic current to the shape memory member and further adapted to stop the flow of electronic current to the shape memory member.

10. The device of claim 1, including at least one limit switch adapted to indicate when the openings are aligned and/or misaligned.

11. An airflow control device, comprising:

a first damper element and a second damper element, each having an opening therethrough, one of said damper elements overlying the other of said damper elements, at least one of said damper elements being movable relative to the other;

a shape memory member adapted to contract in length upon application of an electric current thereto and to elongate upon interruption of the current thereto, said member attached to said at least one of said elements for causing movement of said at least one element by contraction of said member;

an electric current source electrically connected to said member for selectively applying electrical current to said member; and a heater associated with at least one of said elements.

12. The device of claim 11, said heater comprising a heating layer disposed between said elements.

13. An airflow damper comprising:

a fixed damper element having a first plurality of openings therethrough;

a movable damper element juxtaposed over said fixed element and having a second plurality of openings therethrough, said movable damper element being movable between a first position in which said second plurality of openings is not aligned with said first plurality of openings and a second position in which said second plurality of openings is in substantial alignment with said first plurality of openings; and a shape memory wire having one end attached to said movable damper element and a second end attached to said fixed damper element to cause movement of said movable damper upon heating of said wire; and first and second cavities in said fixed damper element and a ball biased outwardly from said movable damper element for rolling into and out of said cavities as said movable damper moves in opposite directions.

14. An airflow damper comprising:

a fixed damper element having a first plurality of openings therethrough;

a movable damper element juxtaposed over said fixed element and having a second plurality of openings therethrough, said movable damper element being movable between a first position in which said second plurality of openings is not aligned with said first plurality of openings and a second position in which said second plurality of openings is in substantial alignment with said first plurality of openings; and a shape memory wire having one end attached to said movable damper element and a second end attached to said fixed damper element to cause movement of said movable damper upon heating of said wire; and a heater element disposed between said fixed damper element and said movable damper element.

15. An airflow damper comprising:

a fixed damper element having first plurality of openings therethrough;

a movable damper element juxtaposed over said fixed element and having a second plurality of openings therethrough, said movable damper element being movable between a first position in which said second plurality of openings is not aligned with said first plurality of openings and a second position in which said second plurality of openings is in substantial alignment with said first plurality of openings; and a shape memory wire having one end attached to said movable damper element and a second end attached to said fixed damper element to cause movement of said movable damper upon heating of said wire; and a heater element associated with at least one of said fixed damper element and said movable damper element.

16. A method for controlling airflow between two compartments, said method comprising steps of:

providing a movable damper element having at least one opening therethrough, the damper element being movable between first and second positions providing different air flow through the element;

providing a shape memory member attached to the damper element, the member being responsive to a temperature thereof to change a physical dimension thereof;

providing an electric circuit electrically connected to the member;

moving the movable damper element by selectively directing an electric current to the shape memory member or interrupting an electric current directed to the shape memory member in response to a need to adjust the position of the movable damper element; and providing a mechanical assist for completing movement of the damper element in at least one direction.

17. The method of claim 16, including providing two shape memory members attached to the damper element and electrically connected to the electric circuit, and selectively directing current to one or the other of the members for moving the element in opposite directions.

18. A method for controlling airflow between two compartments, said method comprising steps of:

providing a movable damper element having at least one opening therethrough, the damper element being movable between first and second positions providing different air flow through the element;

providing a shape memory member attached to the damper element, the member being responsive to a temperature thereof to change a physical dimension thereof;

providing an electric circuit electrically connected to the member; and moving the movable damper element by selectively directing an electric current to the shape memory member or interrupting an electric current directed to the shape memory member in response to a need to adjust the position of the movable damper element; and providing a heater associated with the damper element and electrically connected to the electric circuit; and heating the heater to prevent freeze-up of the damper element.

19. The method of claim 18, including activating the heater before moving the damper element.

20. An airflow control device, comprising:

a first damper element and a second damper element, each having an opening therethrough, one of said damper elements overlying the other of said damper elements, at least one of said damper elements being movable relative to the other;

a shape memory member adapted to contract in length upon application of an electric current thereto and to elongate upon interruption of the current thereto, said member attached to said at least one of said elements for causing movement of said at least one element by contraction of said member;

an electric current source electrically connected to said member for selectively applying electrical current to said member; and a mechanical assist mechanism operable to complete movement of said at least one of said elements in each direction, said mechanical assist mechanism including adjacent cavities and a spring biased member movable into said cavities.

* * * * *